US008177331B2

(12) United States Patent
Asauchi

(10) Patent No.: US 8,177,331 B2
(45) Date of Patent: May 15, 2012

(54) LIQUID JETTING APPARATUS, LIQUID CONTAINER, AND METHOD OF CONTROLLING MULTIPLE LIQUID CONTAINERS

(75) Inventor: Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 600 days.

(21) Appl. No.: 12/364,358

(22) Filed: Feb. 2, 2009

(65) Prior Publication Data

US 2009/0213181 A1 Aug. 27, 2009

(30) Foreign Application Priority Data

Feb. 21, 2008 (JP) ..... 2008-039914

(51) Int. Cl.
*B41J 2/14* (2006.01)
*B41J 2/16* (2006.01)

(52) U.S. Cl. ..... 347/50

(58) Field of Classification Search ..... 347/5, 7, 347/19, 86, 38–72
See application file for complete search history.

(56) References Cited

U.S. PATENT DOCUMENTS

| | | | | |
|---|---|---|---|---|
| 6,634,738 | B1 | 10/2003 | Shinada et al. | |
| 6,908,184 | B2 | 6/2005 | Shinada et al. | |
| 2008/0007577 | A1 * | 1/2008 | Junhua | 347/5 |

FOREIGN PATENT DOCUMENTS

| | | | |
|---|---|---|---|
| CN | 1535836 | A | 10/2004 |
| JP | 06-226989 | | 8/1994 |
| JP | 2001-146030 | | 5/2001 |
| JP | 2002-370383 | | 12/2002 |
| JP | 2003-112431 | | 4/2003 |
| JP | 2004-223717 | A | 8/2004 |
| JP | 2004-299405 | | 10/2004 |

* cited by examiner

*Primary Examiner* — Hai C Pham
(74) *Attorney, Agent, or Firm* — Kilpatrick Townsend & Stockton LLP

(57) ABSTRACT

The liquid jetting apparatus includes a container installation portion, a first wire line, a control circuit and a first switch. The container installation portion receives installation of a first liquid container having a first electrical device. The first wire line, in a state with the first liquid container installed in the container installation portion, electrically connects to the first electrical device. The control circuit transmits or receives a varying signal of varying potential to or from the first electrical device via the first wire line. The first switch supplies a prescribed potential to the first wire line when the control circuit is not transmitting or receiving the varying signal.

13 Claims, 9 Drawing Sheets

LIQUID JETTING APPARATUS, LIQUID CONTAINER, AND METHOD OF CONTROLLING MULTIPLE LIQUID CONTAINERS

CROSS REFERENCE TO RELATED APPLICATIONS

This application relates to and claims priority from Japanese Patent Application No. 2008-39914, filed on Feb. 21, 2008, the entire disclosure of which is incorporated by reference.

BACKGROUND

1. Technical Field

The present invention relates to a liquid jetting apparatus and a liquid container.

2. Description of the Related Art

A liquid jetting apparatus such as an ink-jet printing device is loaded with one or more containers containing a liquid to be jetted out. Liquid containers of this kind furnished with a sensor for sensing the remaining quantity of liquid are known. A controller provided to the liquid jetting apparatus exchanges electrical signals with the sensor of the liquid container, enabling it to sense the remaining quantity of the liquid.

However, in the conventional art, no consideration was given to noise that might be generated by the sensor. For example, discharge noise of piezoelectric elements employed as sensors posed a risk of effects on other liquid containers, or on the printing device. Such problems are not limited to instances of sensor-equipped liquid containers, but are common to liquid containers equipped with any manner of electric device.

SUMMARY

It is accordingly one object of the present invention to provide technology for limiting emitted noise in relation to an electrical device provided to a liquid container.

A first aspect of the invention provides a liquid jetting apparatus. The liquid jetting apparatus of the first aspect comprises a container installation portion, a first wire line, a control circuit and a first switch. The container installation portion receives installation of a first liquid container having a first electrical device. The first wire line, in a state with the first liquid container installed in the container installation portion, electrically connects to the first electrical device. The control circuit transmits or receives a varying signal of varying potential to or from the first electrical device via the first wire line. The first switch supplies a prescribed potential to the first wire line when the control circuit is not transmitting or receiving the varying signal.

According to the liquid jetting apparatus of the first aspect, the first wire line is held at a prescribed potential when it is not being used for signal exchange with the electrical device. As a result, noise emitted from the electrical device via the first wire line may be limited.

In the liquid jetting apparatus pertaining to the first aspect, the container installation portion may further receive installation of a second liquid container having a second electrical device. The liquid jetting apparatus further may comprises a second wire line that, in a state with the second liquid container installed in the container installation portion, electrically connects to the second electrical device. The controller may further transmit or receive the varying signal to or from the second electrical device via the second wire line. The first switch may supply the prescribed potential to the first wire line when the control circuit is not transmitting or receiving the varying signal to or from the second electric device via the second wire line. In this case, noise emitted from the electrical device of the first liquid container may be limited thereby, enabling steady signal exchange between the liquid jetting apparatus and the electrical device of the second liquid container.

In the liquid jetting apparatus pertaining to the first aspect may further comprise a second switch that supplies a prescribed potential to the second wire line when the control circuit is not transmitting or receiving the varying signal to or from the first electric device via the first wire line. In this case, noise emitted from the electrical device of the second liquid container may be limited thereby, enabling steady signal exchange between the liquid jetting apparatus and the electrical device of the first liquid container.

In the liquid jetting apparatus pertaining to the first aspect, the first electrical device may include an oscillator device. In this case, oscillation noise emitted by the oscillator device of the liquid container may be limited thereby.

In the liquid jetting apparatus pertaining to the first aspect, the oscillator device may include a piezoelectric element. In this case, noise emitted by the piezoelectric element of the liquid container may be limited thereby.

In the liquid jetting apparatus pertaining to the first aspect, the first switch may connect the first wire line to the prescribed potential after the transmission or reception of the varying signal to or from the piezoelectric element via the first wire line is finished. In this case, emission of residual noise subsequent to signal exchange with a piezoelectric element may be limited thereby.

A second aspect of the invention provides a liquid jetting apparatus. The liquid jetting apparatus of the second aspect comprises a container installation portion, a plurality of wire lines, a controller and switches. The container installation portion receives installation of a plurality of liquid containers each having an electrical device. The plurality of wire lines, in a state with the plurality of liquid containers installed in the container installation portion, may electrically connect to the electrical devices respectively, the plurality of wire lines including a first wire line connected to a first electrical device among the electrical devices. The controller may transmit or receive varying signals of varying potential to or from the plurality of electrical devices via the plurality of wire lines. The switches may supply a prescribed potential to all the plurality of wire lines except the first line when the controller is transmitting or receiving the varying signal to or from the first electrical device via the first line.

According to the liquid jetting apparatus of the second aspect, noise emitted by other electrical devices may be limited thereby, enabling steady signal exchange between the first electrical device and the liquid jetting apparatus.

A third aspect of the invention provides a liquid container. The liquid container of the third aspect comprises a body, an electrical device, a wire line and a switch. The body contains a liquid. The wire line electrically connects the electrical device to the liquid jetting apparatus when the liquid container has been installed in the liquid jetting apparatus. The switch switches between a first state wherein the liquid jetting apparatus is able to transmit or receive a varying signal to or from the electrical device via the wire line, and a second state wherein the wire line is held at a prescribed potential.

According to the liquid container of the third aspect, by bringing about the second state, noise emitted by the device may be limited.

In the liquid container pertaining to the third aspect, the liquid jetting apparatus may receive installation a plurality of liquid containers. When the liquid jetting apparatus is transmitting or receiving a varying signal to or from the electrical device of one of the liquid containers, the switches of the other liquid containers may hold the wire lines at a prescribed potential. In this case, noise emitted by other electrical devices of other liquid containers may be limited thereby, enabling steady signal exchange between a given electrical device and the liquid jetting apparatus.

In the liquid container pertaining to the third aspect, the electrical device may include an oscillator device. In this case, oscillation noise emitted by the oscillator device of the liquid container may be limited thereby.

In the liquid container pertaining to the third aspect, the oscillator device may include a piezoelectric element. In this case, noise emitted by the piezoelectric element of the liquid container may be limited thereby.

In the liquid container pertaining to the third aspect, the first state may be switched to the second state after the transmission or reception of the varying signal to or from the liquid jetting apparatus via the wire line in the first state is finished. In this case, emission of residual noise subsequent to signal exchange with the liquid jetting apparatus may be limited thereby.

The present invention can be realized in various aspects, for example, a method for a liquid jetting apparatus to control a plurality of liquid containers, a method of controlling multiple liquid containers and a method of accessing an electrical device of a liquid container. The invention can also be realized as a system including a liquid jetting apparatus and a liquid container, a computer program to control a liquid jetting apparatus and a recording medium having such a computer program recorded thereon The above and other objects, characterizing features, aspects and advantages of the invention will be clear from the description of preferred embodiments presented below along with the attached drawings.

DETAILED DESCRIPTION OF THE PREFERRED EMBODIMENTS

A. First Embodiment

Figure 1:
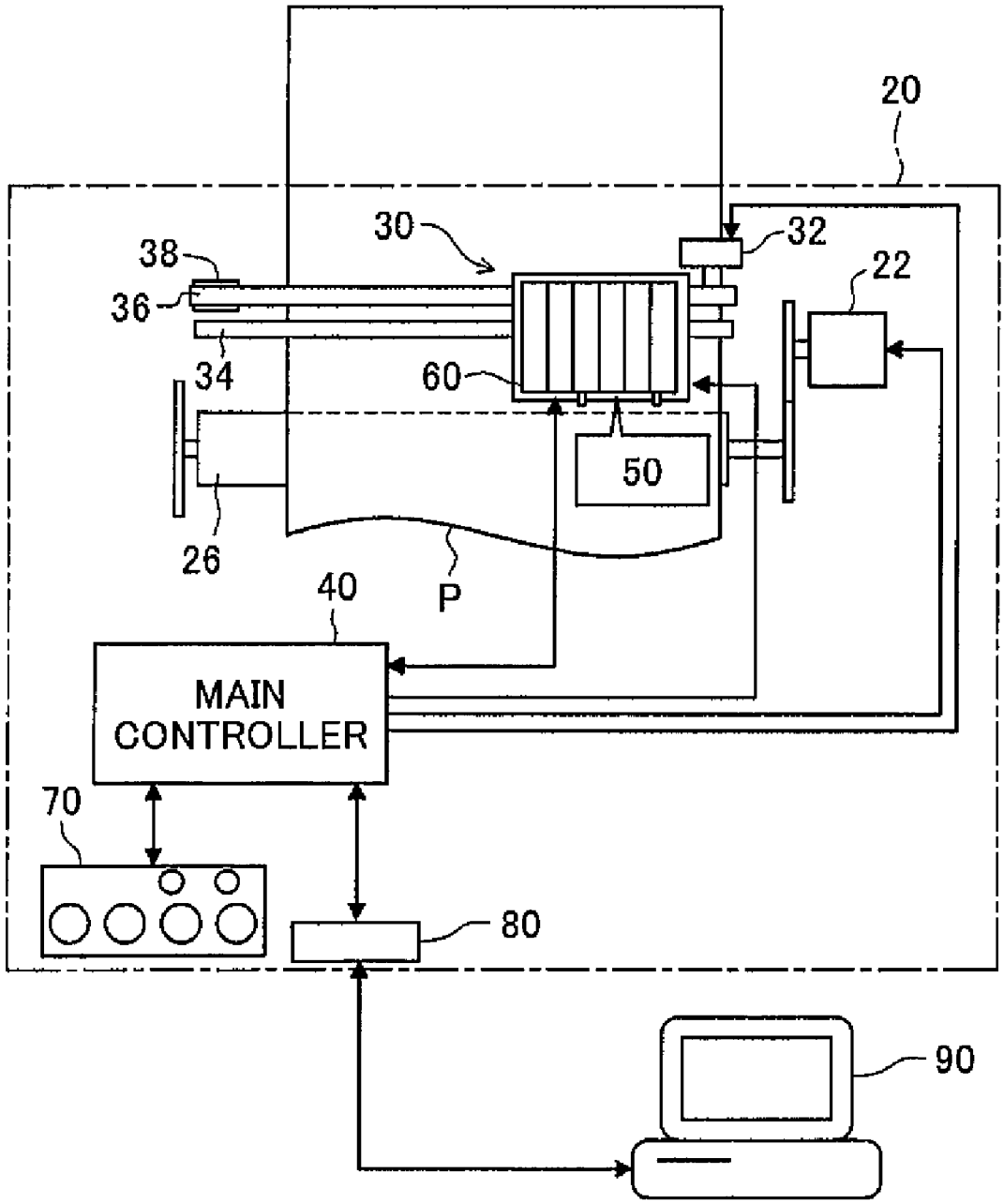
FIG. 1 is an illustration depicting a simplified configuration of a printing system according to First embodiment.

Configuration of Printing System:

FIG. 1 is an illustration depicting a simplified configuration of a printing system according to an embodiment of the present invention. The printing system includes a printer 20 and a computer 90. The printer 20 is connected to the computer 90 through a connector 80.

The printer 20 includes a sub-scan feed mechanism, a main scan feed mechanism, a head driving mechanism, and a main controller 40 for controlling these mechanisms. The sub-scan feed mechanism includes a paper feed motor 22 and a platen 26, and is adapted to transport paper P in the sub-scanning direction by transmitting rotation of the paper feed motor 22 to the platen 26. The main scan feed mechanism includes a carriage motor 32, a pulley 38, a drive belt 36 stretched between the carriage motor and the pulley, and a slide rail 34 disposed parallel to the axis of the platen 26. The slide rail 34 slidably retains a carriage 30 that is affixed to the drive belt 36. Rotation of the carriage motor 32 is transmitted to the carriage 30 via the drive belt 36 so that the carriage 30 undergoes reciprocating motion along the slide rail 34 in the axial direction of the platen 26 (main scanning direction). The head driving mechanism includes a print head unit 60 that rests on the carriage 30, and is adapted to drive the print head and eject ink onto the paper P. A plurality of ink cartridges may be detachably installed on the print head unit 60, as will be discussed later. The printer 20 is additionally furnished with a user-interface 70 allowing the user to make various settings or to check the status of the printer.

Figure 2:
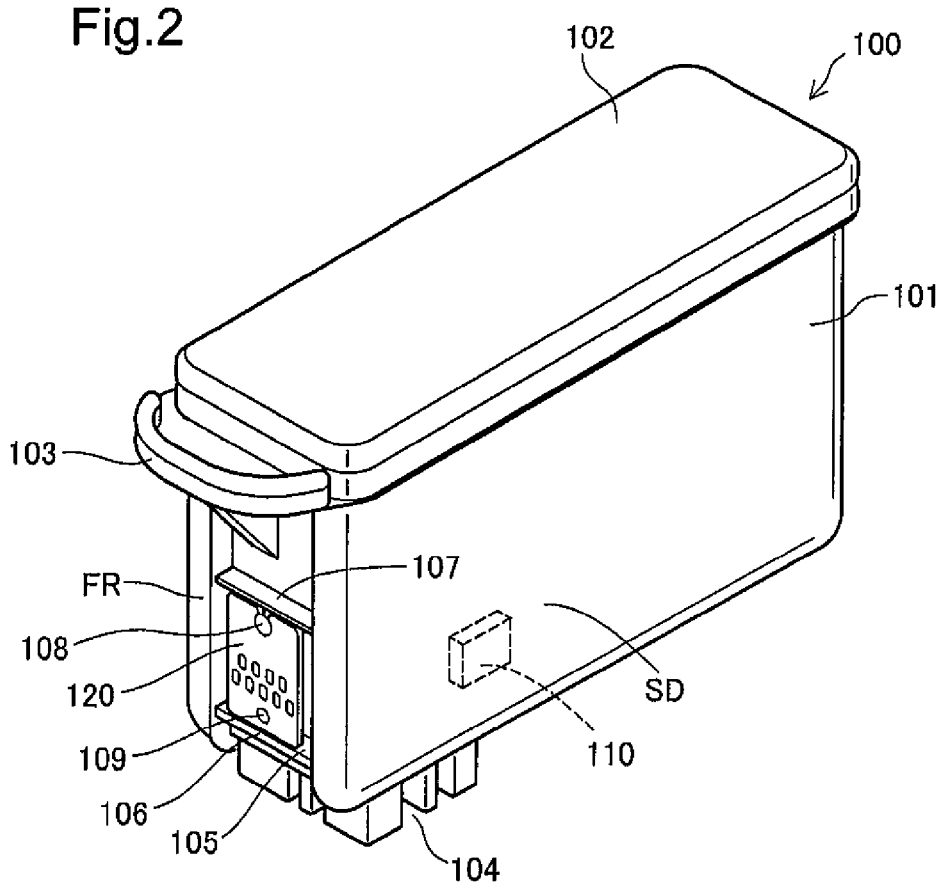
FIG. 2 is a perspective view depicting the configuration of an ink cartridge in First embodiment.

FIG. 2 is a perspective view depicting the configuration of an ink cartridge in First embodiment. The ink cartridge 100 includes a housing 101 that contains ink; a cover for sealing off an opening of the housing 101; a board 120; and a sensor 110. An ink supply port 104 adapted to deliver ink to the print head unit 60 when the cartridge has been installed on the print head unit 60 is formed on the bottom face of the housing 101. A projecting portion 103 is formed at the upper edge of the front face FR of the housing 101. A recessed portion 105 that is bordered at top and bottom by ribs 107 and 106 is also formed on the front face FR of the housing 101, at a location to the lower side of center (i.e. towards the bottom). The aforementioned board 120 fits within the recessed portion 105. The sensor 110 is embedded in the side wall SD of the housing 101. As will be discussed later, the sensor 110 includes a piezoelectric element and is used to sense the remaining ink level.

Figure 3A:
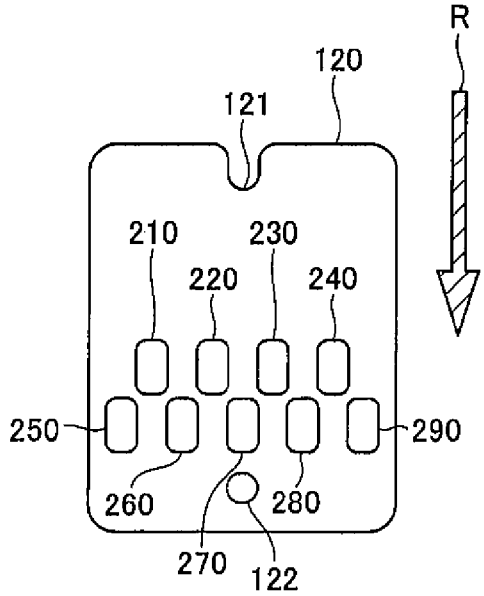
FIGS. 3A-B are drawings depicting the configuration of the board according to First embodiment.
Figure 3B:
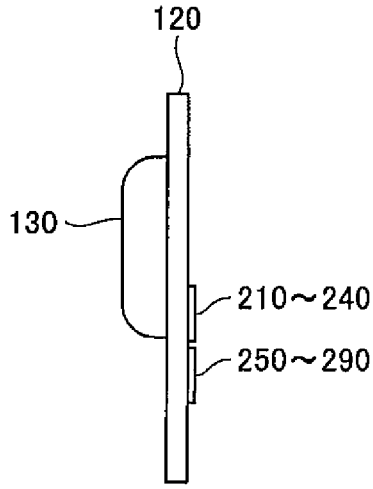

FIGS. 3A-B are drawings depicting the configuration of the board according to First embodiment. FIG. 3A depicts the configuration of the front face of the board 120. The front face is the face that will lie exposed to the outside when the ink cartridge 100 is installed. FIG. 3B depicts the configuration of the board 120 viewed from the side. A boss slot 121 is formed at the upper edge of the board 120, and a boss hole 122 is formed at the lower edge of the board 120. As shown in FIG. 2, during installation of the board 120 in the recessed portion 105 of the housing 101, bosses 108 and 109 that have been formed on the base face of the recessed portion 105 will mate with the boss slot 121 and the boss hole 122. Te bosses 108 and 109 will then be collapsed at their distal end to produce rivet fastenings. The board 120 is fastened within the recessed portion 105 thereby.

Figure 4:
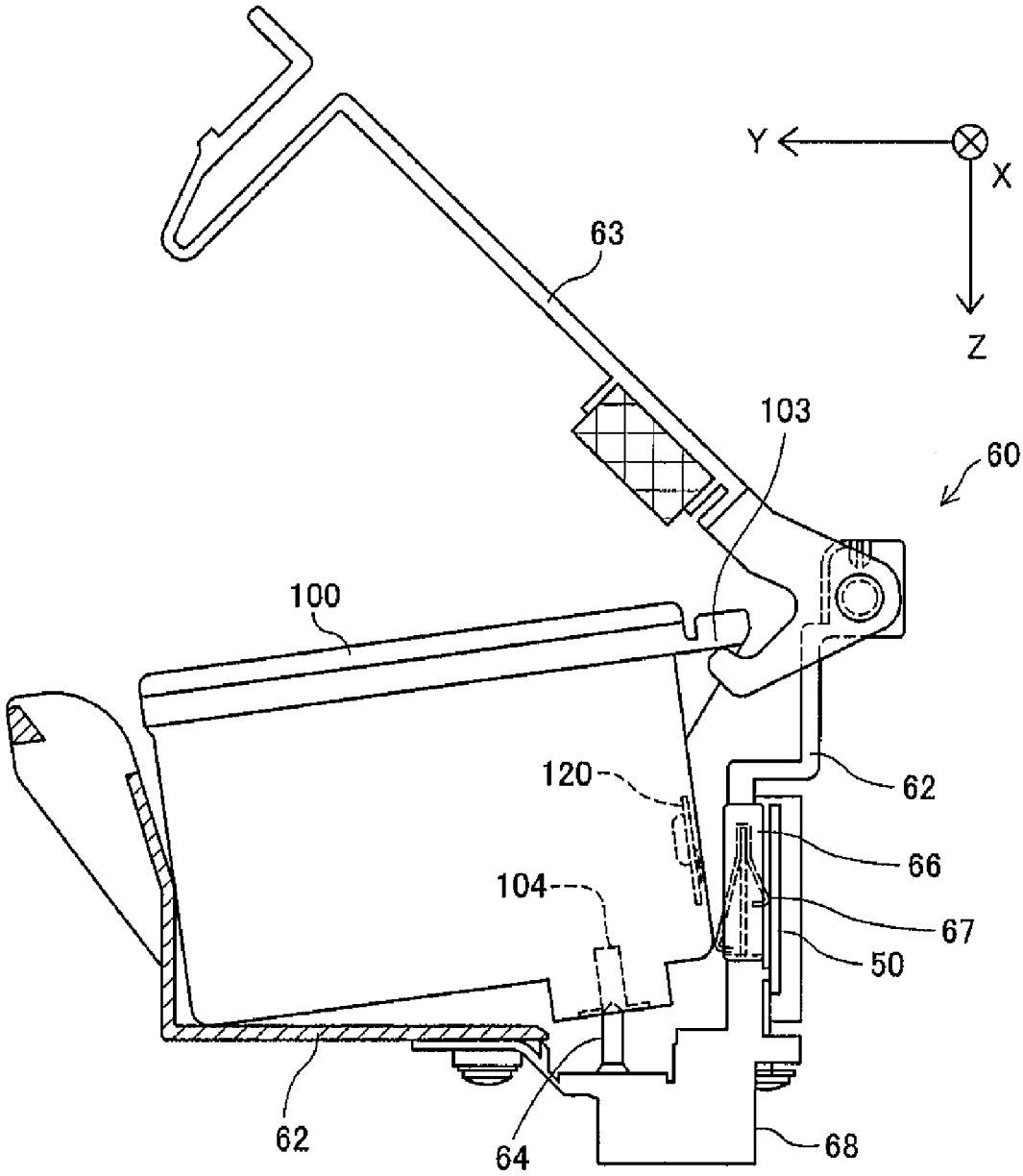
FIG. 4 is an illustration depicting the configuration of the print head unit.

FIG. 4 is an illustration depicting the configuration of the print head unit 60. The print head unit 60 includes a holder 62, a holder cover 63, a connector mechanism 66, a print head 68, and a carriage circuit 50. The holder 62 accommodates installation of several ink cartridges 100, and is disposed on the upper face of the print head 68. The holder cover 63 is openably and closably provided for each installed ink cartridge and is attached to the upper part of the print head 68. The connector mechanism 66 includes conductive connector terminals 67 for electrical connection between the carriage circuit 50 and terminals that are provided on the board 102 of the ink cartridge 100 (discussed later) and the connector terminal 67 is provided for each of the terminals of the board 102. An ink supply needle 64 for supplying ink from the ink cartridge 100 to the print head 68 is disposed on the upper face of the print head 68. The print head 68 includes a plurality of nozzles and a plurality of piezoelectric elements, and is adapted to eject drops of ink from the nozzles in response to voltage applied to the piezoelectric elements to produce dots on the paper P. The carriage circuit 50 is a circuit for carrying out control in conjunction with the main controller 40 in relation to the ink cartridge 100; herein it will also be called a "sub-controller."

With the holder cover 63 open, the ink cartridge 100 will be installed in the holder 62, and the holder cover 63 is then closed to secure the ink cartridge 100 to the holder 62. With the ink cartridge 100 secured to the holder 62, the ink supply needle 64 will insert into the ink supply port 104 of the ink cartridge 100 so that the ink contained in the ink cartridge 100 is supplied to the print head via the ink supply needle 64. As will be appreciated from the above discussion, the ink cartridge 100 is installed in the holder by inserting it in the forward direction of the Z axis in FIG. 4.

Returning now to FIGS. 3A-B, the board 120 will be discussed further. The arrow R in FIG. 3A indicates the insertion direction of the ink cartridge 100 mentioned above. As depicted in FIG. 3B, the board 120 is provided on its back face with a memory 130, and on its front face with a terminal group composed of nine terminals. The memory 130 includes a memory array; data of various kinds, for example, data relating to the ink, such as remaining ink level and ink color, or to the ink cartridge 100 itself, is stored in the memory array.

The terminals are generally oblong in shape and arranged so as to form two parallel rows generally perpendicular to the insertion direction R. Of these two rows; the row lying towards the insertion direction R, i.e. the row situated on the lower side in FIG. 3A, shall be termed the lower row, while the row lying on the opposite side from the insertion direction R, i.e. the row situated on the upper side in FIG. 3A, shall be termed the upper row. The terminals that make up the upper row and the terminals that make up the lower row are arranged differently from one another in a staggered arrangement such that the terminals will not line up with one another in the insertion direction R.

The terminals arrayed to form the upper row are, in order from left in FIG. 3A, a first short detection terminal 210, a ground terminal 220, a power supply terminal 230, and a second short detection terminal 240. The terminals arrayed to form the lower row are, in order from left in FIG. 3A, a first sensor drive terminal 250, a reset terminal 260, a clock terminal 270, a data terminal 280, and a second sensor drive terminal 290. The five terminals situated in proximity to the center in the left-right direction, namely, the ground terminal 220, the power supply terminal 230, the reset terminal 260, the clock terminal 270, and the data terminal 280, are respectively connected to the memory 130. The two terminals situated at the ends of the lower row, namely, the first sensor drive terminal 250 and the second sensor drive terminal 290, are connected respectively to a first electrode and a second electrode of the piezoelectric element that is contained in the sensor 110. The first short detection terminal 210 is connected to the ground terminal 220. The second short detection terminal 240 is not connected to anything.

When the ink cartridge 100 is fastened in the holder 62, the terminals of the board 120 will be placed in electrical connection with the sub-controller (carriage circuit) 50 via the connector terminals 67 of the connector mechanism 66.

Electrical Configuration of Printer

Figure 5:
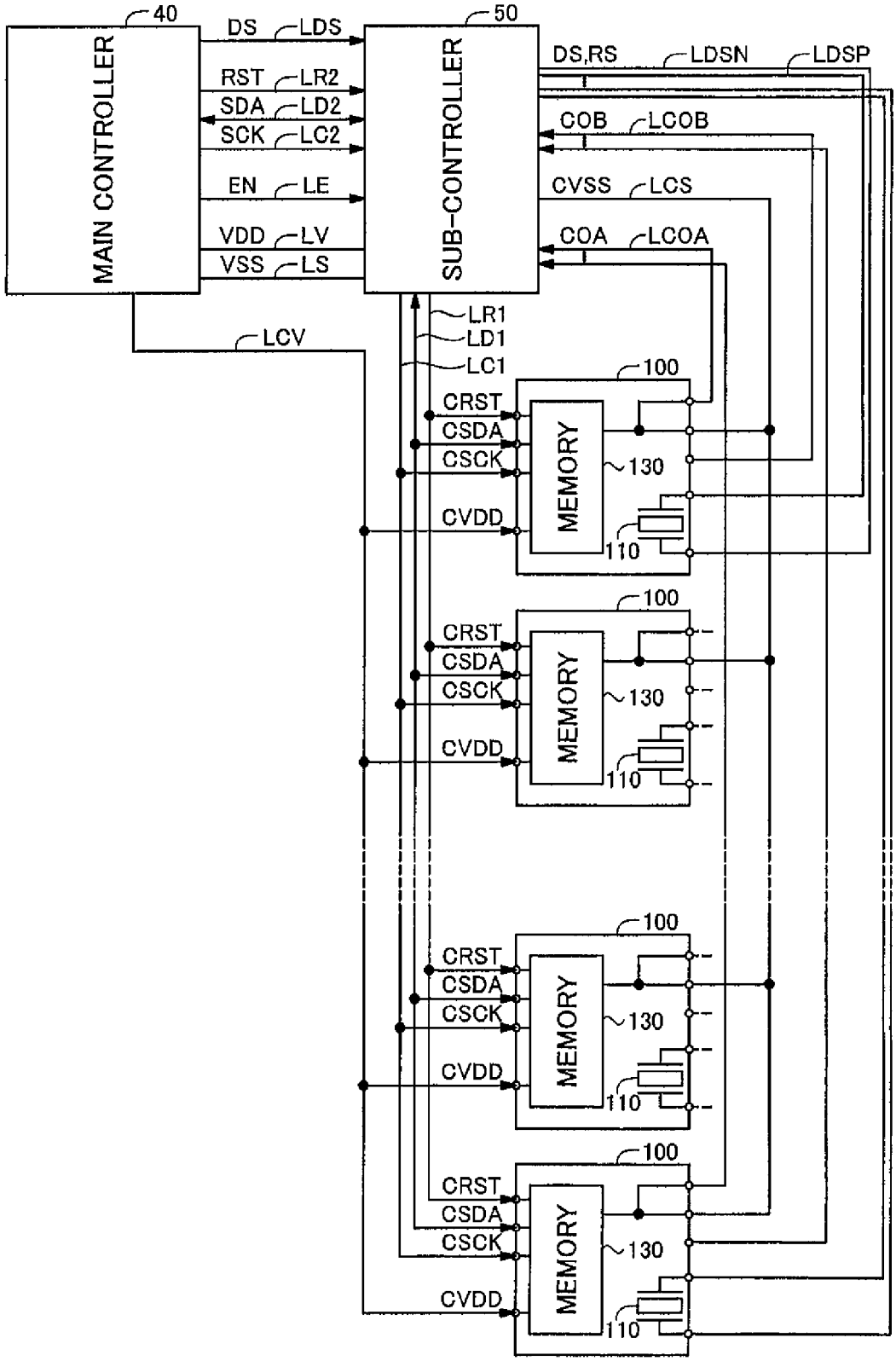
FIG. 5 is a first illustration depicting the electrical configuration of the printer in First embodiment.

FIG. 5 is a first illustration depicting the electrical configuration of the printer. The Illustration in FIG. 5 focuses upon the main controller 40, the sub-controller 50, and the ink cartridges 100 in their entirety. The memory 130 of each ink cartridge 100 has been assigned a unique 3-bit ID number (identification number). Where six ink cartridges 100 have been installed, their six memorys 130 will be respectively assigned ID numbers from "001" to "110" for example.

The sub-controller 50 and the ink cartridges 100 are interconnected by multiple wire lines. These wire lines include a first reset signal line LR1, a first data signal line LD1, a first clock signal line LC1, a first ground line LCS, a first short detection line LCOA, a second short detection line LCOB, a first sensor signal line LDSN, and a second sensor signal line LDSP.

The first reset signal line LR1 is a conductive line adapted to transmit a first reset signal CRST, and is electrically connected to the memory 130 via the reset terminal 260 of the board 120. The first data signal line LD1 is a conductive line adapted to transmit a first data signal CSDA, and is electrically connected to the memory 130 via the data terminal 280 of the board 120. The first clock signal line LC1 is a conductive line adapted to transmit a first clock signal CSCK, and is electrically connected to the memory 130 via the clock terminal 270 of the board 120. These three lines LR1, LD1, LC1 are respectively lines having a single terminus on the sub-controller 50 end, and branched termini on the ink cartridge 100 end corresponding in number to the number of ink cartridges 100. Using these three lines LR1, LD1, LC1, the sub-controller 50 can access the memory 130 of each ink cartridge 100.

The first ground line LCS is a conductive line adapted to supply ground potential CVSS to the memory 130, and is electrically connected to the memory 130 via the ground terminal 220 of the board 120. The first ground line LCS is a line having a single terminus on the sub-controller 50 end, and branched termini on the ink cartridge 100 end corresponding in number to the number of ink cartridges 100. The ground potential CVSS is connected to ground potential VSS supplied to the sub-controller 50 by the main controller 40 (discussed later), and is set to GND level.

The first short detection line LCOA and the second short detection line LCOB are conductive lines used for short detection, discussed later. The first short detection lines LCOA and the second short detection lines LCOB are respectively composed of a multiplicity of lines provided independently for each ink cartridge 100 and electrically connected at one end to the sub-controller 50 while electrically connected at the other end to the first short detection terminal 210 and the second short detection terminal 240, respectively, of the board 120.

The first sensor signal line LDSN and the second sensor signal line LDSP are conductive lines adapted to apply driving voltage to the piezoelectric element of the sensor 110, and to transmit voltage produced by the piezoelectric effect of the piezoelectric element to the sub-controller 50. The first sensor signal line LDSN and the second sensor signal line LDSP are respectively composed of a multiplicity of lines provided independently for each ink cartridge 100 and electrically connected at one end to the sub-controller 50, while electrically connected at the other end to the first sensor drive terminal 250 and the second sensor drive terminal 240, respectively, of the board 120. The first sensor signal line LDSN is electrically connected via the first sensor drive terminal 250 to one of the electrodes of the piezoelectric element of the sensor 110, while the second first sensor signal line LDSP is electrically connected via the second sensor drive terminal 290 to the other electrode of the piezoelectric element of the sensor 110.

The main controller 40 and the ink cartridges 100 are connected by a first power supply line LCV. The first power supply line LCV is a conductive line adapted to supply power supply potential CVDD to the memory 130, and is connected to the memory 130 via the power terminal 230 of the board 120. The first power supply line LCV is a line having a single terminus on the sub-controller 50 end, and branched termini on the ink cartridge 100 end corresponding in number to the number of ink cartridges 100. The high-level power supply potential CVDD used to drive the memory 130 is a potential on the order of 3.3 V versus the ground level potential CVSS (GND level) which represents the low level. The potential level of the power supply potential CVDD may differ depending on the process generation of the memory 130; instead, 1.5 V or 2.0 V could be employed, for example.

The main controller 40 and the sub-controller 50 are electrically interconnected by multiple lines. These multiple lines include a second reset signal line LR2, a second data line LD2, a second clock signal line LC2, an enable signal line LE, a second power supply line LV, a second ground line LS, and a third sensor drive signal line LDS.

The second reset signal line LR2 and the second clock signal line LC2 are conductive lines for transmitting a second reset signal RST and a second clock signal SCK, respectively, to the sub-controller 50. The second data line LD2 is a conductive line for sending of a second data signal SDA between the main controller 40 and the sub-controller 50. Using these signal lines LR2, LC2, LD2, the main controller 40 can carry out data communication with the sub-controller 50.

The enable signal line LE is a conductive line adapted to transmit an enable signal from the main controller 40 to the sub-controller 50. The second power supply line LV and the second ground line LS are conductive lines adapted to supply power supply potential VDD and ground potential VSS, respectively, from the main controller 40 to the sub-controller 50. The power supply potential VDD will be one having the same level as the aforementioned power supply potential CVDD that is supplied to the memory 130, for example, potential on the order of 3.3 V versus ground potential VSS and CVSS (GND level). The potential level of the power supply potential VDD may differ depending on the process generation of the logic section of the sub-controller 50; instead, 1.5 V or 2.0 V could be employed, for example.

Figure 6:
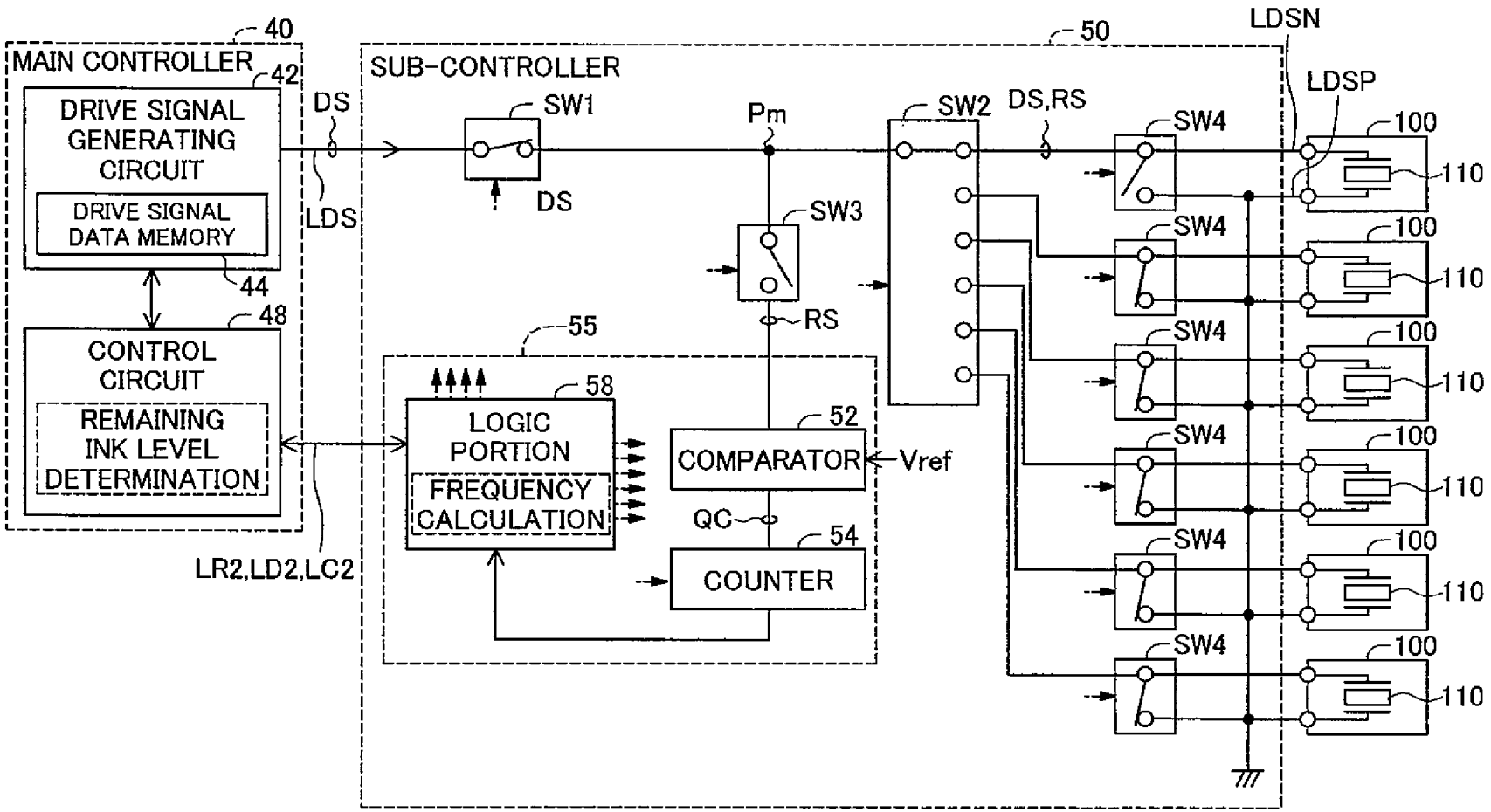
FIG. 6 is a second illustration depicting the electrical configuration of the printer in First embodiment.

FIG. 6 is a second illustration depicting the electrical configuration of the printer. The illustration in FIG. 6 focuses on the sections necessary for determining remaining ink level. The main controller 40 includes a drive signal generating circuit 42, and a first control circuit 48 that includes a CPU and memory.

The drive signal generating circuit 42 is equipped with a drive signal data memory 44. In the drive signal data memory 44 there is stored data representing a sensor drive signal DS for the purpose of driving the sensor. In accordance with an instruction from the first control circuit 48, the drive signal generating circuit 42 will read out the data from the drive signal data memory 44, and generate a sensor drive signal DS having a desired waveform.

In the present embodiment, the drive signal generating circuit 42 can additionally generate a head drive signal to be supplied to the print head 68. Specifically, in the present embodiment, the first control circuit 48, will use the drive signal generating circuit 42 to generate a sensor drive signal when executing a determination of remaining ink level; and will use the drive signal generating circuit 42 to generate a head drive signal when executing printing. Herein the sensor drive signal shall be termed simply a "drive signal."

The sub-controller 50 is equipped with four different switches SW1 to SW4, and a second control circuit 55. For the switches SW1 to SW3, one each is provided, whereas the switches SW4 are provided in a number equal to the number of installable ink cartridges, specifically, six in the case of the present embodiment. The second control circuit 55 includes a comparator 52, a counter 54, and a logic portion 58. The logic portion 58 controls the operation of the switches SW1 to SW3 and the counter 54. In the present embodiment, the logic portion 58 is composed of a single chip (ASIC).

The first switch SW1 is a one-channel analog switch. One terminal of the first switch SW1 is connected via the third sensor signal drive line LDS to the drive signal generating circuit 42 of the main controller 40, while the other terminal is connected to the second and third switches SW2, SW3. The first switch SW1 will be set to the On state when presenting the sensor 110 with a drive signal DS, and will be set to the Off state when sensing a response signal RS from the sensor 110.

The second switch SW2 is a six-channel analog switch. A single terminal on one side of the second switch SW2 is connected to the first and third switches SW1, SW3, while each of six terminals on its other side is respectively connected to a terminal situated on one side of each of the six fourth switches SW4, as well as being respectively connected to one of the electrodes of the sensor 110 of each of the six ink cartridges 100.

The third switch SW3 is a one-channel analog switch. One terminal of the third switch SW3 is connected to the first and second switches SW1, SW2, while its other terminal is connected to the comparator 52 of the second control circuit 55. The third switch SW3 will be set to the Off state when presenting the sensor 110 with a drive signal DS, and will be set to the On state when sensing a response signal RS from the sensor 110.

The fourth switches SW4 are one-channel analog switches. A terminal on one side of each of the six fourth switches SW4 is respectively connected to one of the six terminals situated on the other side of the second switch SW2 as described previously, as well as being respectively connected to one of the electrodes of the sensor 110 of each of the six ink cartridges 100. The other terminal of each of the six fourth switches SW4 are grounded. The other electrode of each sensor 110 is grounded.

The comparator 52 includes an op-amp, and is adapted to compare the response signal RS presented to it via the third switch SW3 with a reference voltage Vref and to output a signal QC indicating the outcome of the comparison. Specifically, if the response signal RS is equal to or greater than the reference voltage Vref the comparator 52 will set the output signal QC to H level, and if the response signal RS is less than the reference voltage Vref it will set the output signal QC to L level.

The counter 54 counts the number of pulses contained in the output signal QC from the comparator 52, and presents the count value to the logic portion 58. The counter 54 executes the count operation during the time interval that it has been set to the enabled state by the logic portion 58.

The logic portion 58 controls the second switch SW2 and selects one of the sensors 110. The logic portion 58 will place the fourth switch SW4 that is connected to the selected one sensor 110 in the Off state, and place the fourth switches SW4 connected to the other five sensors in the On state. When a drive signal DS is supplied to the sensor 110, the logic portion 58 will set the first switch SW1 to the On state and the third switch SW3 to the Off state. When detecting a response signal RS from the sensor 110, the logic portion 58 will set the first switch SW1 to the Off state and the third switch SW3 to the On state.

The logic portion 58 will set the counter 54 to the enabled state for the time interval that the response signal RS from the sensor 110 is to be sensed. Utilizing the count value in the counter 54, the logic portion 58 will then measure the time interval required until a prescribed number of pulses contained in the output signal QC from the comparator 52 have been generated (the measurement interval). Specifically, the sub-controller 50 is provided internally with an oscillator (not shown); a clock signal output by this oscillator is utilized to measure the measurement interval. The logic portion 58 will calculate the frequency Hc of the response signal RS on the basis of the measurement interval and the number of pulses of the output signal QC counted by the counter. The frequency Hc of the response signal RS is equivalent to the frequency at which the piezoelectric element of the sensor 110 oscillates. The computed frequency Hc will be supplied to the first control circuit of the main controller 40.

On the basis of the calculated frequency Hc, the first control circuit 48 of the main controller 40 will decide whether the remaining ink level inside the selected ink cartridge 100 is equal to or greater than a prescribed level. Specifically, if the calculated frequency Hc is approximately equal to a first oscillation frequency H1, it will be decided that the remaining ink level is equal to or greater than a prescribed level, whereas if approximately equal to a second oscillation frequency H2, it will be decided that the remaining ink level is less than a prescribed level. These oscillation frequencies H1, H2 can be determined experimentally beforehand as characteristic frequencies corresponding to the respective remaining ink levels.

The main controller 40 and the sub-controller 50 will cooperate to determine the remaining ink level of each ink cartridge in the above manner. The first control circuit 48 of the main controller 40 will supply the decision outcome to the computer 90. As a result, the computer can notify the user of the decision outcome regarding remaining ink levels.

Figure 7:
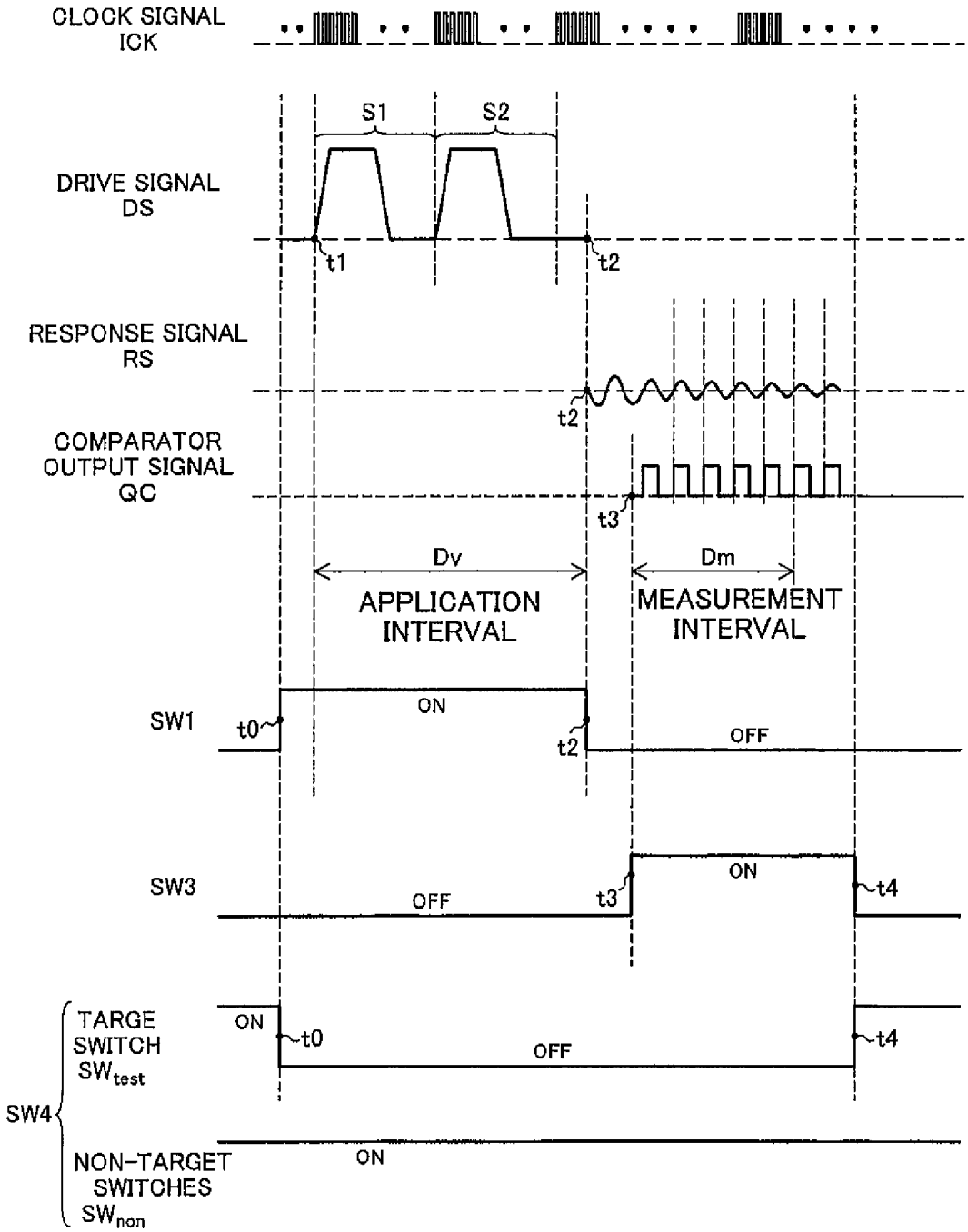
FIG. 7 is a timing chart of an instance of measuring the frequency of a response signal using the sensor in First embodiment.

FIG. 7 is a timing chart of an instance of measuring the frequency of a response signal RS using the sensor in First embodiment. In FIG. 7, a clock signal ICK, a drive signal DS, a response signal RS, and an output signal QC of the comparator are shown. The clock signal ICK is the output of the internal oscillator (not shown) of the sub-controller 50. The drive signal DS and the response signal RS are signals measured at point Pm in FIG. 4.

Also shown in FIG. 7 is a timing chart of operation of the first switch SW1, the third switch SW3, and the fourth switches SW4. Operation of the fourth switches SW4 is shown separately for a target switch $SW_{test}$ and non-target switches $SW_{non}$. The target switch $SW_{test}$ represents the one switch, from among the six fourth switches SW4, that is connected to the one sensor 110 that was selected by the second switch SW2. The non-target switches $SW_{non}$ represent the five switches, from among the six fourth switches SW4, that are connected to the five sensors 110 that were not selected by the second switch SW2.

The sub-controller 50 will carry out determination of the remaining ink levels of the ink cartridges 100 in accordance with an instruction sent from the main controller 40 via the aforementioned signal lines LR2, LC2, LD2. First, at time t0, the first switch SW1 will be switched from the Off to the On state, and any one of the sensors 110 will be selected by the second switch SW2. Then, a target switch $SW_{test}$ selected from among the fourth switches SW4 will be switched from the On to the Off state. As a result, the first sensor signal line LDSN connecting the selected sensor 110 with the sub-controller 50 will be released from its state of connection to the ground terminal. Consequently, it will now be possible for signals to be sent between the selected sensor 110 and the sub-controller 50 via the first sensor signal line LDSN. Specifically, it will be possible for a drive signal DS to be applied to the sensor 110 by the sub-controller 50, and for a response signal RS from the sensor 110 to be received by the second control circuit 55. Meanwhile, the non-target switches $SW_{non}$ among the six fourth switches SW4 will be maintained in the On state. As a result, the first sensor signal lines LDSN connecting the unselected sensors 110 to the sub-controller 50 will be maintained in a state of connection to the ground terminal. As a result, potential on the first sensor signal lines LDSN connecting the unselected sensors 110 to the sub-controller 50 will be held at GND level.

From time t1 to t2 (application interval Dv), the drive signal DS is supplied to the sensor 110, and voltage is applied to the piezoelectric element. During the application interval Dv, the third switch SW3 will be set to the Off state.

As illustrated, the drive signal DS includes two pulse signals S1, S2. The two pulse signals S1, S2 are set to the same cycle T. The cycle T is set to correspond to a cycle (=1/H1) corresponding to the characteristic frequency H1 of the piezoelectric element observed when the remaining ink level in the ink cartridge is equal to or greater than a prescribed level (e.g. approximately 33 μs).

At time t2, the first switch SW1 will switch to the Off state, and supply of the drive signal to the sensor 110 will terminate. Then, subsequent to time t2, the sensor 110 (piezoelectric element) will oscillate according to the remaining ink level, and a response signal RS will be output from the sensor.

At time t3 which follows time t2 by a slight delay, the third switch SW3 will switch to the On state. At this time, the response signal RS from the sensor 110 will be supplied to the comparator 52. The comparator 52 will compare the response signal RS with the reference voltage Vref, and output an H level or L level signal QC.

During interval Dm beginning at time t3 (measurement interval Dm), the logic portion 58 of the sub-controller 50 will set the counter 54 to the enabled state, and measure the time required for five pulses to be output by the comparator 52 (measurement interval Dm). Specifically, the logic portion 58 will measure the measurement interval Dm by counting the number of pulses of the clock signal occurring during the interval that the counter 54 counts five pulses, i.e. during the interval between counting of the rising edge of the first pulse and counting of the rising edge of the sixth pulse. Once the counter 54 has counted the rising edge of the sixth pulse, the logic portion 58 will set the counter 54 to the disabled state. Then, on the basis of the number of pulses (five) of the output signal QC counted by the counter 54 and the measured measurement interval Dm, the logic portion 58 will calculate the frequency Hc (=5/Dm) of the first signal component contained in the response signal RS. As noted, the calculated frequency He indicates the frequency of oscillation of the piezoelectric element.

The control circuit 48 of the main controller 40 will receive the measured frequency Hc of the first signal component, and on the basis of the frequency Hc will determine whether the remaining ink level is equal to or greater than a prescribed level. At time t4 after the measurement interval Dm has ended, the third switch SW3 will be returned from the On state to the Off state, and the target switch $SW_{test}$ will be returned from the Off state to the On state.

According to First embodiment described above, during the interval that signals are exchanged between the sub-controller 50 and the sensor 110 of the ink cartridge 100 that is currently targeted for determination of remaining ink level, the first sensor signal lines LDSN of the sensors 110 of the non-targeted ink cartridges 100 will be grounded by the fourth switches SW4. As a result, noise emitted by the sensors 110 of the non-targeted ink cartridges 100 can be limited, and signal exchange between the sub-controller 50 and the sensor 110 targeted for determination of remaining ink level can be stabilized.

B. Second Embodiment

In First embodiment, during the application interval Dv the line connected to ground potential GND is held to the second sensor signal line LDSP and the line connected to the drive signal DS is held to the first sensor signal line LDSN; however, an arrangement whereby the line connected to ground potential GND and the line connected to the drive signal DS are selectively switchable would be acceptable as well. In First embodiment, the same line (namely, the first sensor signal line LDSN) serves both as the line for transmitting the drive signal DS and the line for transmitting the response signal RS; however, these could be different lines instead. Second embodiment below describes a specific example of such an arrangement.

Figure 8:
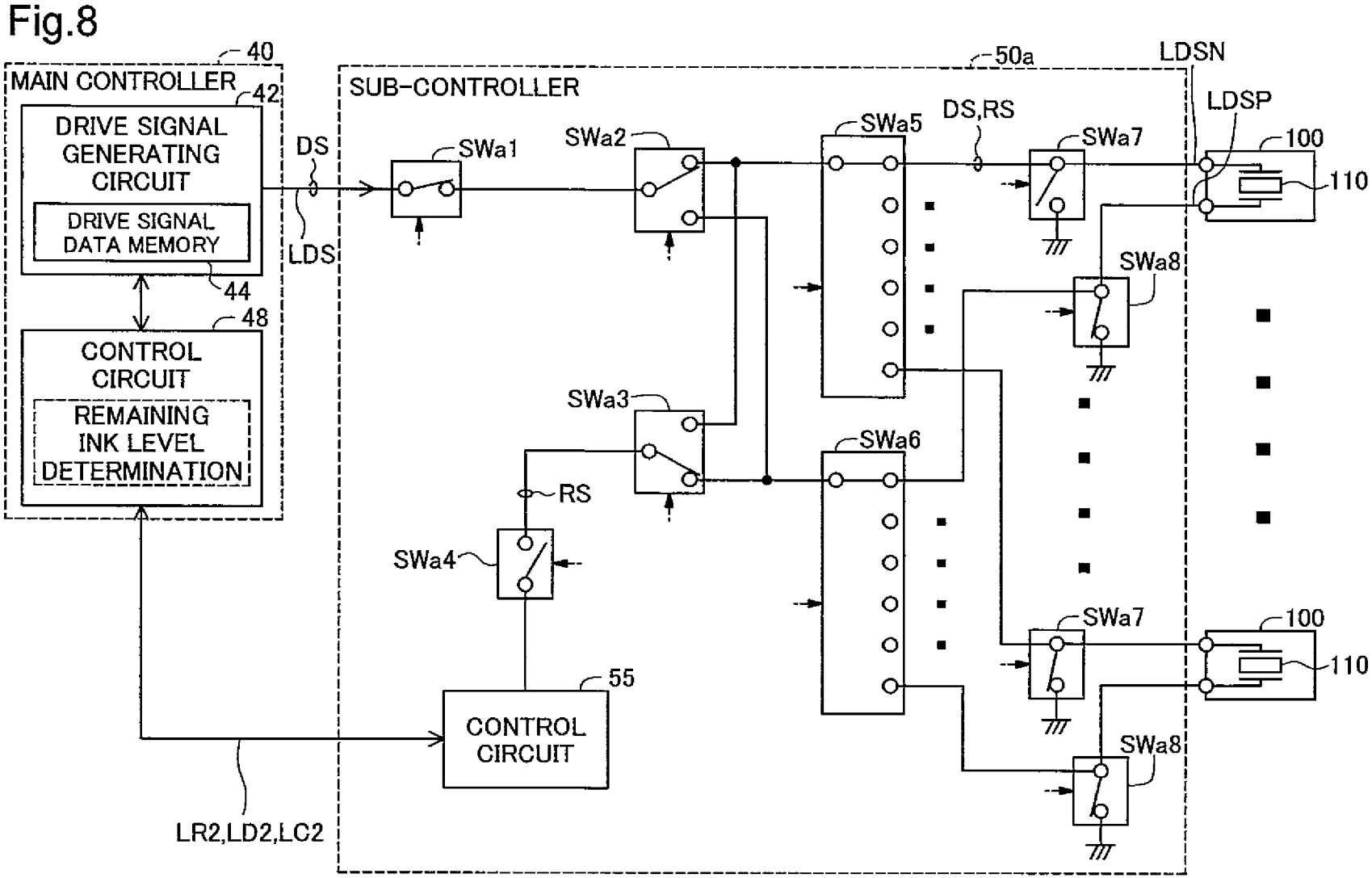
FIG. 8 is an illustration depicting the electrical configuration of a printer in Second embodiment.

FIG. 8 is an illustration depicting the electrical configuration of a printer in Second embodiment. The illustration in FIG. 8 focuses on the sections necessary for determining remaining ink level. The configurations of the main controller 40 and of the control circuit 55 are the same as the configurations assigned like symbols in First embodiment that was described with reference to FIG. 6.

The sub-controller 50*a* in Second embodiment is provided with switches SWa1 to Swa8. These switches SWa1 to SWa8 are controlled by the logic portion of the sub-controller 50*a*. The first switch SWa1 is a one-channel analog switch. One terminal of the first switch SWa1 is connected to the drive signal generating circuit 42 of the main controller 40, while its other terminal is connected to the second switch SWa2. The first switch SWa1 will be set to the On state when the sensor 110 is supplied with a sensor drive signal DS from the drive signal generating circuit 42. In Second embodiment, the sensor drive signal DS is inputtable to the sensor 110 via either the first or second sensor signal line LDSN, LDSP. The first switch SWa1 will be set to the Off state during input of a response signal RS from the sensor 110 to the second control circuit 55 via the signal line to which the drive signal DS was input from among the first and second sensor signal lines LDSN, LDSP. The first switch SWa1 will be set to the On state during input to the second control circuit 55 via a different signal line from the signal line to which the drive signal DS was input from among the first and second sensor signal lines LDSN, LDSP.

The second switch SWa2 and the third switch SWa3 are two-channel analog switches. The one terminal situated on a first side of the second switch SWa2 is connected to the first switch SWa1. Of the two terminals on the other side of the second switch SWa2, one is connected to the fifth switch SWa5 while the other is connected to the sixth switch SWa6. The one terminal situated on a first side of the third switch SWa3 is connected to the fourth switch SWa4. Of the two terminals on the other side of the third switch SWa3, one is connected to the fifth switch SWa5 while the other is connected to the sixth switch SWa6. The second switch SWa2 is a switch for selecting a signal line to which to input a drive signal DS to the sensor 110 from among the first and second sensor signal lines LDSN, LDSP. In the state depicted in FIG. 8, the first sensor signal line LDSN has been selected. The third switch SWa3 is a switch for selecting a signal a signal line to which to input a response signal RS from the sensor 110 from among the first and second sensor signal lines LDSN, LDSP. In the state depicted in FIG. 8, the second sensor signal line LDSP has been selected.

The fourth switch SWa4 is a one-channel analog switch. One terminal of the fourth switch SWa4 is connected to the comparator 52 (FIG. 6) of the second control circuit. The other terminal of the fourth switch SWa4 is connected to the third switch SWa3. The fourth switch SWa4 will assume the On state during the response signal RS frequency measuring interval Dm, and will assume the Off state at other times.

The fifth and sixth switches SWa5, SWa6 are six-channel analog switches. The one terminal on a first side of the fifth switch SWa5 is connected to the second switch SWa2. The six terminals on the other side of the fifth switch SWa5 are respectively connected to the terminal on a first side of one of the six seventh switches SWa7, and also connected via the first sensor signal lines LDSN to one electrode of the respective sensors 110 of the six ink cartridges 100. The one terminal on a first side of the sixth switch SWa6 is connected to the third switch SWa3. The six terminals on the other side of the sixth switch SWa6 are respectively connected to the terminal on a first side of one of the six eighth switches SWa8, and also connected via the second sensor signal lines LDSP to the other electrode of the respective sensors 110 of the six ink cartridges 100. The fifth and sixth switches SWa5, SWa6 are switches adapted to select a sensor 110 targeted for control (target sensor) from among the respective sensors 110 of the six ink cartridges 100. In the state depicted in FIG. 8, the sensor 110 of the ink cartridge 100 shown uppermost has been selected.

The seventh and eighth switches SWa7, SWa8 are one-channel analog switches. The terminal situated on one side of each of the six seventh switches SWa7 is connected to one of the six terminals situated on the other side of the fifth switch SWa5, and also connected via the first sensor signal lines LDSN to one electrode of the respective sensors 110 of the six ink cartridges 100. The other terminal of each of the six seventh switches SWa7 is grounded. The terminal situated on one side of each of the six eighth switches SWa8 is connected to one of the six terminals situated on the other side of the sixth switch SWa6, and also connected via the second sensor signal lines LDSP to the other electrode of the respective sensors 110 of the six ink cartridges 100. The other terminal of each of the six eighth switches SWa8 is grounded.

Of the six seventh switches SWa7, the one switch that is connected to the target sensor will be set to the Off state at times that a drive signal DS or a response signal RS is exchanged between the sub-controller 50 and the target sensor via the first sensor signal line LDSN. Meanwhile, of the six seventh switches SWa7, the five switches that are connected to non-targeted sensors will assume the normally On state, and their first sensor signal lines LDSN will be grounded. That is, the potential on the first sensor signal lines LDSN that connect the non-targeted sensors to the sub-controller 50 will be normally held at GND level.

Analogously, of the six eighth switches SWa8, the one switch that is connected to the target sensor will be set the Off state at times that a drive signal DS or a response signal RS is exchanged between the sub-controller 50 and the target sensor via the second sensor signal line LDSP. Meanwhile, of the six eighth switches SWa8, the five switches that are connected to non-targeted sensors will assume the normally On state, and their second sensor signal lines LDSP will be grounded. That is, the potential on the second sensor signal lines LDSP that connect the non-targeted sensors to the sub-controller 50 will be normally held at GND level.

According to Second embodiment described above, during time intervals that signals are being exchanged between the sub-controller 50 and an ink cartridge 100 targeted for determination of remaining ink level, the first and second sensor signal lines LDSN, LDSP of the sensors 110 of the non-targeted ink cartridges 100 will be grounded by the seventh and eighth switches Swa7, SWa8 respectively. As a result, noise emitted by the sensors 110 of the non-targeted ink cartridges 100 can be limited, and signal exchange between the sub-controller 50 and the sensor 110 targeted for determination of remaining ink level can be stabilized.

C. Third Embodiment

In First embodiment, the fourth switches SW4 are provided to the sub-controller 50 of the printer 20, and the first sensor signal lines LDSN of non-targeted sensors are held at GND level; however, switches could be provided to the ink cartridges 100 instead. Third embodiment describes a specific example of such an arrangement.

Figure 9:
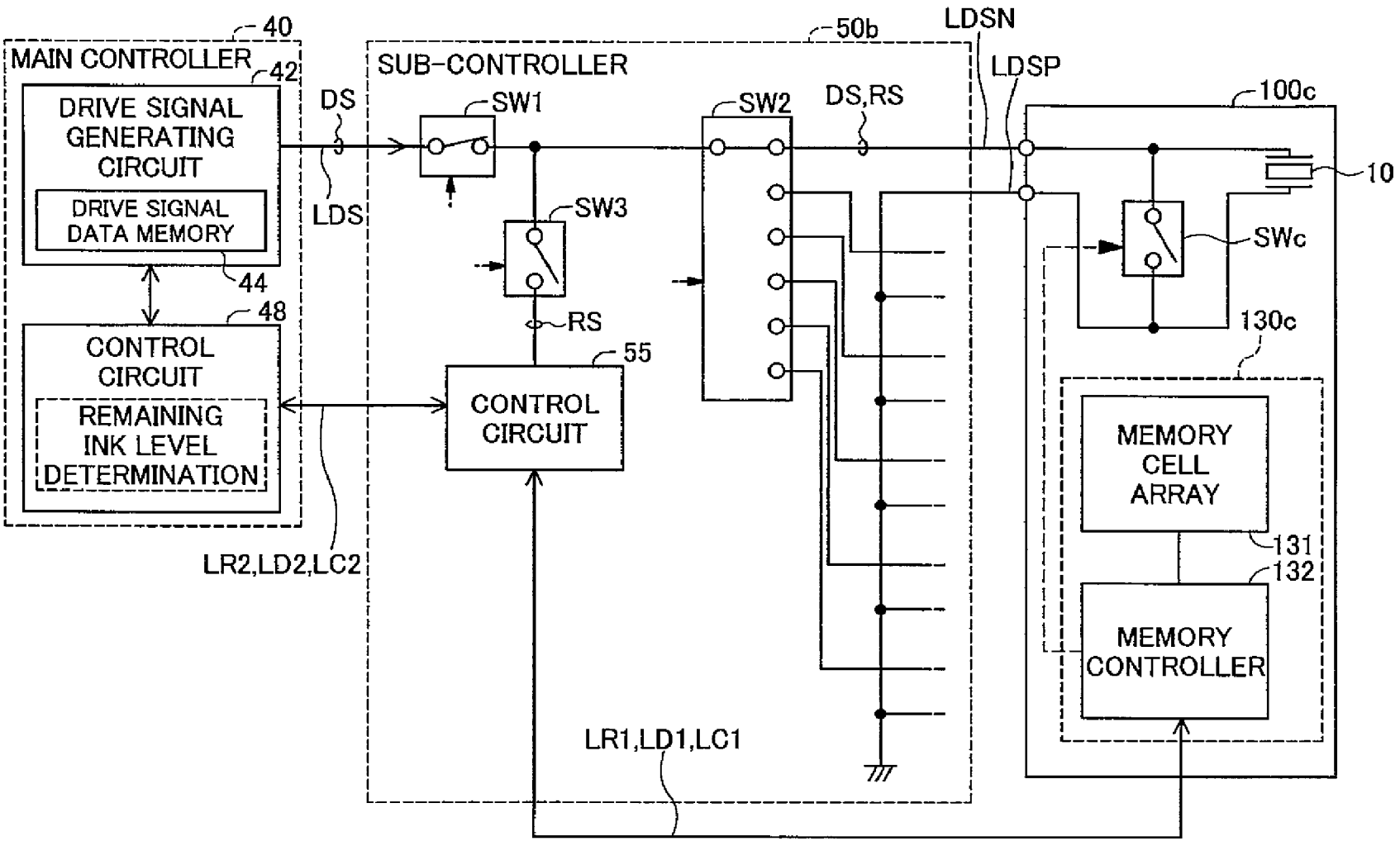
FIG. 9 is an illustration depicting the electrical configuration of a printer in Third embodiment.

FIG. 9 is an illustration depicting the electrical configuration of a printer in Third embodiment. The illustration in FIG. 9 focuses on the sections necessary for determining remaining ink level. The configuration of the main controller 40 is the same as that of the embodiment described with reference to FIG. 6. In FIG. 9, the configuration of the sub-controller 50*b* is the same as that of the embodiment described with reference to FIG. 6, except that the fourth switches SW4 have been omitted. Therefore, for equivalent configurations, the same symbols used in FIG. 6 are used in FIG. 9, and no description is provided.

In Third embodiment each ink cartridge 100*c* is provided with an analog switch SWc disposed between the electrodes of the sensor 110. With the ink cartridge 100*c* installed in the printer 20, when its analog switch SWc assumes the On state, the first sensor signal line LDSN will be grounded via the analog switch SWc and the second sensor signal line LDSP, and held at GND level. Meanwhile, with the ink cartridge 100*c* installed in the printer 20, when its analog switch SWc in the Off state, the sub-controller 50*b* will be able to exchange signals with the sensor 110 via the first sensor signal line LDSN.

In Third embodiment each ink cartridge 100*c* is also provided with a memory 130. The memory 130*c* includes a memory array 131 and a memory controller 132. The memory controller 132 is adapted to exchange signals with the second control circuit 55 of the sub-controller 50*b* via signal lines LR2, LD2, LC2, and to control the memory array 131. For example, the memory controller 132 will write to the memory array 131 data that it has received as a signal from the second control circuit 55. The memory controller 132 will also send to the second control circuit 55, in the form of a signal, data that it has read out from the memory array 131.

In the present embodiment, the memory controller 132 additionally performs control of the analog switch SWc. When the ink cartridge 100*c* installed in the printer 20, the memory controller 132 will place the analog switch SWc in the On state. When its parent ink cartridge 100*c* has been targeted for determination of remaining ink level, the memory controller 132 will place the analog switch SWc in the Off state.

Figure 10:
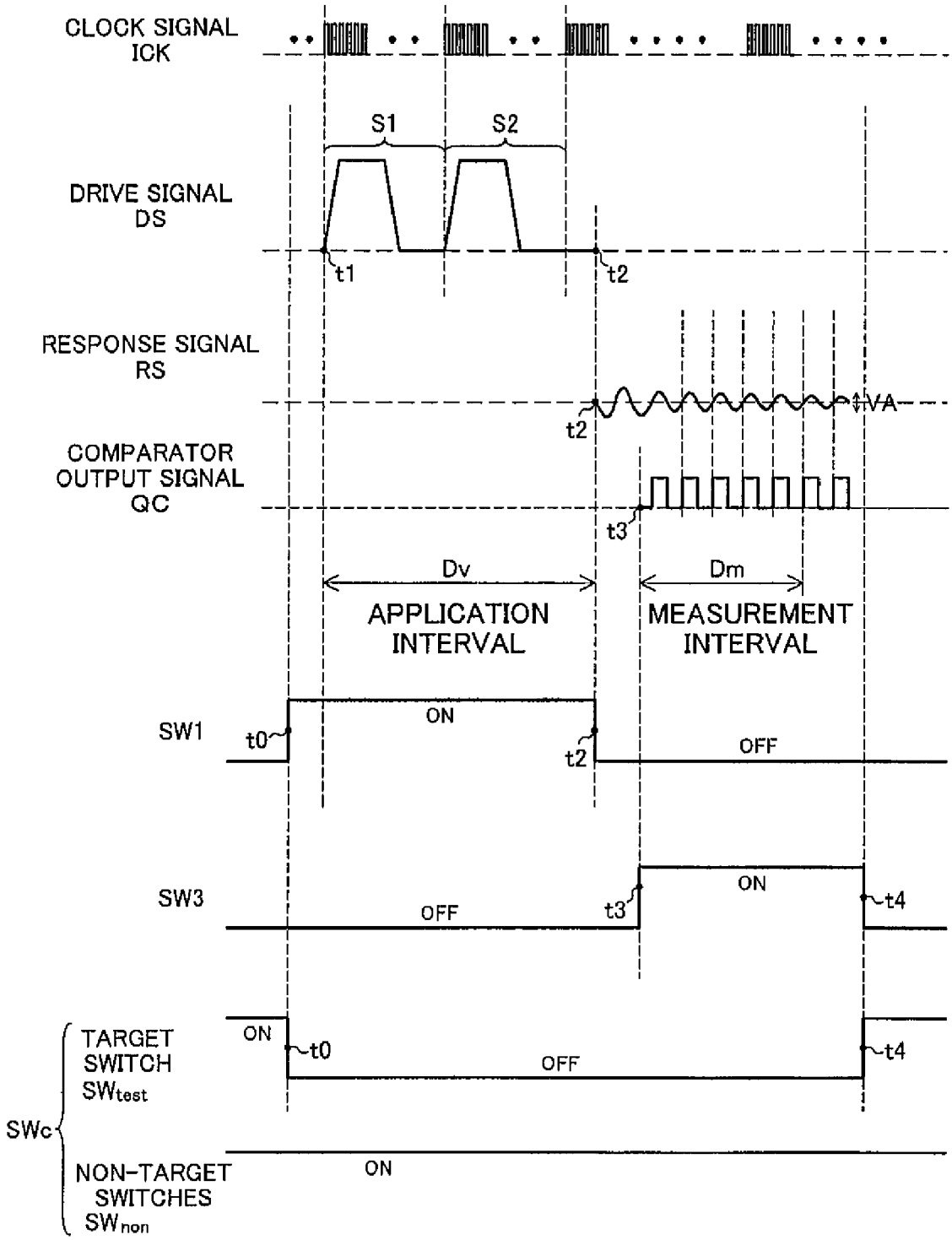
FIG. 10 is a timing chart of an instance of measuring the frequency of a response signal using the sensor in Third embodiment.

FIG. 10 is timing chart of an instance of measuring the frequency of a response signal using the sensor in Third embodiment. In FIG. 10, the content of the timing chart for the clock signal ICK, the drive signal DS, the response signal RS, and comparator output signal QC is the same as in the timing chart of these same signals in FIG. 7. In FIG. 10, the timing chart for operation of the first switch SW1 and the third switch SW3 is the same as in the timing chart of these same switches in FIG. 7.

In FIG. 10, operation of the analog switch SWc is shown separately for operation of the analog switch SWc of the target container, and operation of the analog switch SWc of a non-targeted container. The target container is the ink cartridge that, of the six ink cartridges 100 installed in the printer 20, is the one selected by the second switch SW2. The non-targeted containers are the five ink cartridges that, of the six ink cartridges 100 installed in the printer, have not been selected by the second switch SW2.

In a manner analogous to that for the non-targeted switches in First embodiment (FIG. 7), during the time that the remaining ink level determination is taking place the analog switches SWc of the non-targeted containers will be held in the On state. Meanwhile, in a manner analogous to that for the targeted switch in First embodiment (FIG. 7), during the time that the remaining ink level determination is taking place, i.e. during the interval from time t0 to time t4, the analog switch SWc of the targeted container will be switched to the Off state. Through communication using the signal lines LR2, LD2, LC2, the memory controller 132 is notified by the second control circuit 55 that remaining ink level determination will be carried out for its parent ink cartridge 100*c* as the target container. Through this notification, the memory controller 132 can carry out switching control of the analog switch SWc at the appropriate times t0 and t4.

According to Third embodiment described above, during the time interval that signals are exchanged between the sub-controller 50 and the sensor 110 of an ink cartridge 100 targeted for ink level determination (target container), the first sensor line LDSN of the sensor 110 of non-targeted ink cartridges 100 (non-targeted containers) will be grounded by the analog switch SWc. As a result, noise emitted by the sensors 110 of non-targeted ink cartridges 100 can be limited, and signal exchange between the sub-controller 50 and the sensor 110 targeted for determination of remaining ink level can be stabilized.

D. Variations

Variation 1:

While in the preceding embodiments, remaining ink level sensors that use piezoelectric elements were employed, but instead it would be possible to employ oscillator devices such as oscillator circuits that send back a response signal of a particular frequency depending on the type (e.g. color) of ink; or to employ a processor such as a CPU or ASIC, or a simpler IC, to carry out some type of exchange with the sub-controller 50. Typically, an electronic device that exchanges signals with the printer via a line will be employed.

Variation 2:

In the preceding embodiments, during signal exchange between the sub-controller 50 and one of the sensors 110, the lines that connect the sub-controller 50 to the other sensors 110 will be held at GND level; however, these lines could instead be held at GND level for some other interval. For example, immediately following the end of a signal exchange between the sub-controller 50 and one of the sensors 110, the line connecting the sub-controller 50 and this one sensor 110 could be held at GND level. The likelihood of residual charge remaining in a sensor 110 is very high immediately after a signal exchange with the sensor 110, and the sensor 110 will tend to emit noise. By holding the line connecting the sensor 110 and the sub-controller 50 at GND level during the time interval that noise tends to be emitted, adverse effects of noise emitted by the sensor 110 can be limited. Generally speaking, a line may be held at GND level during any time interval apart from the interval in which signal exchange takes place with a sensor 110 using the line in question. By so doing, noise emitted by the sensor 110 can be limited during the interval that the line is held at GND level.

Variation 3:

In the preceding embodiments, the line connecting the sub-controller 50 with a sensor 110 is held at GND level in order to limit noise emitted from the sensor 110; however, it could instead be held at the power supply potential VDD level (e.g. at 3.3 V). In general, noise on a line can be limited by holding it at a prescribed constant potential.

Variation 4:

In the preceding First embodiment, the logic portion 58 of the sub-controller 50 is composed of a single ASTC, and the lines connecting the sub-controller 50 with the sensors 110 are grounded by analog switches disposed outside the ASIC; however, it would be acceptable for the sub-controller 50 in its entirety to be composed of a single ASIC, and to ground the lines through switches employing transistors disposed inside the ASIC.

Variation 5:

In the preceding embodiments, a single ink tank constitutes a single ink cartridge, but instead multiple ink tanks could constitute a single ink cartridge.

Variation 6:

In the preceding embodiments, an ink-jet printer and an ink cartridge for ink-jet printer use were employed, but it would be possible to instead employ a liquid jetting apparatus that jets or ejects some other liquid besides ink, and a liquid container for use in such a liquid jetting apparatus. Herein, the term liquid is used to include liquids in which particles of functional material have been dispersed in a medium; or fluids such as gels. Examples would be liquid jetting apparatus that jet fluids containing in dispersed or dissolved form materials such as electrode materials or coloring matter used in the manufacture of liquid crystal displays, EL (electroluminescence) displays, surface emitting displays, or color filters; liquid jetting apparatus used for jetting liquids containing bioorganic substances used in biochip manufacture; or specimen jetting devices used as precision pipettes. Further examples are liquid jetting apparatus used for pinpoint application of lubricants in precision instruments such as clocks or cameras; liquid jetting apparatus for jetting ultraviolet curing resins or other transparent resin solutions onto a substrate for the purpose of forming a micro semi-spherical lens (optical lens) for use in optical communication elements etc.; or liquid jetting apparatus for jetting acid or alkali etchant solution for etching circuit boards. etc. The present invention is applicable to any of the above types of liquid jetting apparatus and to liquid containers for these liquid jetting apparatus.

Variation 7:

In the above embodiments, part of the functions actualized by the hardware configuration may be attained by the software configuration. On the contrary, part of the functions actualized by the software configuration may be attained by the hardware configuration.

While the technology pertaining to the invention have been shown and described on the basis of the embodiments and variations, the embodiments of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

What is claimed is:

1. A liquid jetting apparatus comprising:

a container installation portion that receives installation of a first liquid container having a first electrical device;

a first wire line that, in a state with the first liquid container installed in the container installation portion, electrically connects to the first electrical device;

a control circuit that transmits or receives a varying signal of varying potential to or from the first electrical device via the first wire line; and a first switch that supplies a prescribed potential to the first wire line when the control circuit is not transmitting or receiving the varying signal.

2. The liquid jetting apparatus in accordance with claim 1, wherein the container installation portion further receives installation of a second liquid container having a second electrical device, the liquid jetting apparatus further comprises:

a second wire line that, in a state with the second liquid container installed in the container installation portion, electrically connects to the second electrical device, wherein the controller further transmits or receives the varying signal to or from the second electrical device via the second wire line, and the first switch supplies the prescribed potential to the first wire line when the control circuit is transmitting or receiving the varying signal to or from the second electric device via the second wire line.

3. The liquid jetting apparatus in accordance with claim 2 further comprising:

a second switch that supplies a prescribed potential to the second wire line when the control circuit is transmitting or receiving the varying signal to or from the first electric device via the first wire line.

4. The liquid jetting apparatus in accordance with claims 1, wherein the first electrical device includes an oscillator device.

5. The liquid jetting apparatus in accordance with claim 4, wherein the oscillator device includes a piezoelectric element.

6. The liquid jetting apparatus in accordance with claim 4, wherein the first switch connects the first wire line to the prescribed potential after the transmission or reception of the varying signal to or from the piezoelectric element via the first wire line is finished.

7. A liquid jetting apparatus comprising:

a container installation portion that receives installation of a plurality of liquid containers each having an electrical device;

a plurality of wire lines that, in a state with the plurality of liquid containers installed in the container installation portion, electrically connect to the electrical devices respectively, the plurality of wire lines including a first wire line connected to a first electrical device among the electrical devices;

a controller that transmits or receives varying signals of varying potential to or from the plurality of electrical devices via the plurality of wire lines; and switches that supply a prescribed potential to all the plurality of wire lines except the first line when the controller is transmitting or receiving the varying signal to or from the first electrical device via the first wire line.

8. A liquid container attachable to a liquid jetting apparatus, the liquid container comprising:

a body that contains a liquid;

an electrical device;

a wire line that electrically connects the electrical device to the liquid jetting apparatus when the liquid container has been installed in the liquid jetting apparatus; and a switch that switches between a first state wherein the liquid jetting apparatus is able to transmit or receive a varying signal to or from the electrical device via the wire line, and a second state wherein the wire line is held at a prescribed potential.

9. The liquid container in accordance with claim 8, wherein the liquid jetting apparatus receives installation a plurality of liquid containers; and when the liquid jetting apparatus is transmitting or receiving a varying signal to or from the electrical device of one of the liquid containers, the switches of the other liquid containers hold the wire lines at a prescribed potential.

10. The liquid container in accordance with claim 8, wherein the electrical device includes an oscillator device.

11. The liquid container in accordance with claim 10, wherein the oscillator device includes a piezoelectric element.

12. The liquid container in accordance with claim 10, wherein the first state is switched to the second state after the transmission or reception of the varying signal to or from the liquid jetting apparatus via the wire line in the first state is finished.

13. A method for a liquid jetting apparatus to control a plurality of liquid containers each having an electrical device, the method comprising:

selecting a liquid container to be controlled from among the plurality of liquid containers;

transmitting or receiving a varying signal of varying potential to or from an electrical device of the selected liquid container via a wire line; and when the varying signal is transmitted to or received from the electrical device of the selected liquid container, applying a prescribed potential to a plurality of wire lines that are respectively connected to the electrical devices of the liquid containers which are not selected as the liquid container to be controlled.

* * * * *